US011959403B2

(12) United States Patent
Murphy

(10) Patent No.: US 11,959,403 B2
(45) Date of Patent: Apr. 16, 2024

(54) SINGLE ACTUATOR SHIFTING CAM SYSTEM

(71) Applicant: Neil A Murphy, White Lake, MI (US)

(72) Inventor: Neil A Murphy, White Lake, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 17/342,883

(22) Filed: Jun. 9, 2021

(65) Prior Publication Data

US 2022/0397045 A1 Dec. 15, 2022

(51) Int. Cl.

| | |
|---|---|
| ***F01L 13/00*** | (2006.01) |
| ***F01L 1/047*** | (2006.01) |
| ***F01L 1/08*** | (2006.01) |

(52) U.S. Cl.

CPC ..... *F01L 13/0036* (2013.01); *F01L 1/047* (2013.01); *F01L 1/08* (2013.01); *F01L 13/0063* (2013.01); *F01L 2013/0052* (2013.01)

(58) Field of Classification Search

CPC ..... F01L 13/0063; F01L 1/047; F01L 1/08; F01L 13/0036; F01L 2013/0052; F01L 2001/0473; F01L 2001/0475; F01L 1/34413

USPC ..... 123/90.6, 90.15; 74/567

See application file for complete search history.

(56) References Cited

U.S. PATENT DOCUMENTS

| | | | |
|---|---|---|---|
| 8,387,579 B2 | 3/2013 | Stolk et al. | |
| 9,631,523 B2 | 4/2017 | Eppinger et al. | |
| 10,539,051 B2 | 1/2020 | Wigsten et al. | |
| 2011/0079191 A1 | 4/2011 | Lengfeld et al. | |
| 2012/0138000 A1 | 6/2012 | Schädel et al. | |
| 2014/0020642 A1 | 1/2014 | Stolk et al. | |
| 2016/0084368 A1 | 3/2016 | Meusel et al. | |
| 2017/0248043 A1* | 8/2017 | Kaan | F01L 1/047 |
| 2018/0094554 A1* | 4/2018 | Kaan | F01L 13/0036 |
| 2018/0100414 A1* | 4/2018 | Gallon | F02D 13/0203 |
| 2019/0003351 A1* | 1/2019 | Kataoka | F01L 1/053 |

FOREIGN PATENT DOCUMENTS

| | | | | |
|---|---|---|---|---|
| DE | 102009056224 A1 * | 6/2011 | ..... | F01L 13/0042 |
| DE | 102014217584 A1 * | 3/2016 | ..... | F01L 13/0036 |
| DE | 102016012967 A1 * | 5/2018 | ..... | F01L 1/053 |
| DE | 102018000435 A1 * | 7/2019 | ..... | F01L 13/0042 |

OTHER PUBLICATIONS

DE-102018000435-A1, English Language Machine Translation (Year: 2019).*

* cited by examiner

*Primary Examiner* — Wesley G Harris
(74) *Attorney, Agent, or Firm* — Jeremy J. Klobucar

(57) ABSTRACT

A camshaft assembly for a vehicle valvetrain having first and second engine valves includes a camshaft, and a first camshaft cartridge axially displaceable along the camshaft and including a plurality of first cam lobes configured to selectively impart movement to the first engine valve. A second camshaft cartridge is axially displaceable along the camshaft and includes a plurality of second cam lobes configured to selectively impart movement to the second engine valve. An actuator is configured to axially displace the first camshaft cartridge along the camshaft. A coupling is between the first camshaft cartridge and the second camshaft cartridge. Axial displacement of the first camshaft cartridge selectively imparts movement to the second camshaft cartridge for axial displacement of the second camshaft cartridge.

18 Claims, 1 Drawing Sheet

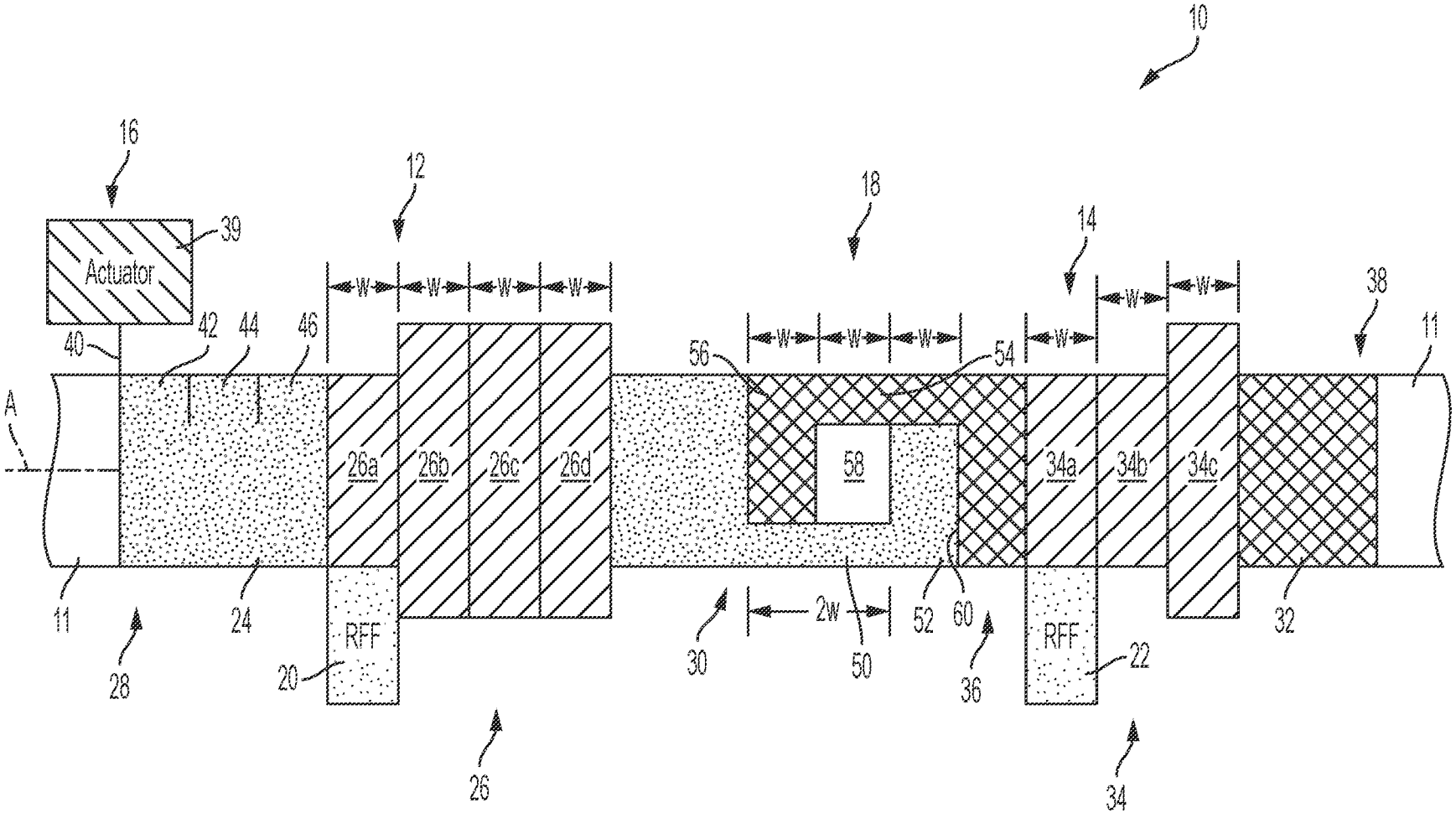
10
11
38
32
34c
34b
34a
22
RFF
34
14
W
54
60
36
52
18
58
50
2W
56
30
26d
26c
26b
26a
26
12
RFF
20
46
44
24
39
42
Actuator
16
40
28
11
A

SINGLE ACTUATOR SHIFTING CAM SYSTEM

FIELD

The present application relates generally to a motor vehicle valve train and, more particularly, to a valve train arrangement with dual shifting camshaft cartridges operated by a single actuator.

BACKGROUND

Vehicle valve trains typically include a camshaft to control the timing and duration of an opening and closing of intake and exhaust valves associated with engine cylinders. The camshaft typically includes a plurality of cam lobes or cam profiles each having a shape configured to provide the desired valve lift and duration. Some camshafts are axially shiftable by an actuator to provide variable valve lift and timing. However, many systems require multiple actuators or have limited options for actuator placement. Therefore, while such systems do work well for their intended purpose, it is desirable to provide continuous improvement in the relevant art.

SUMMARY

In accordance with one example aspect of the invention, a camshaft assembly for a vehicle valvetrain having first and second engine valves is provided. In one example implementation, the camshaft assembly includes a camshaft, and a first camshaft cartridge axially displaceable along the camshaft and including a plurality of first cam lobes configured to selectively impart movement to the first engine valve. A second camshaft cartridge is axially displaceable along the camshaft and includes a plurality of second cam lobes configured to selectively impart movement to the second engine valve. An actuator is configured to axially displace the first camshaft cartridge along the camshaft. A coupling is between the first camshaft cartridge and the second camshaft cartridge. Axial displacement of the first camshaft cartridge selectively imparts movement to the second camshaft cartridge for axial displacement of the second camshaft cartridge such that only the single actuator is needed to axially shift the first and second camshaft cartridges without having to directly engage both of the first and second camshaft cartridges.

In addition to the foregoing, the described assembly may include one or more of the following features: wherein the first camshaft cartridge includes a first shaft having the plurality of first cam lobes, and wherein the second camshaft cartridge includes a second shaft having the plurality of second cam lobes; wherein a first end of the first shaft is configured to engage a first end of the second shaft to form the coupling; and wherein the first shaft first end includes a first axially extending portion and a first finger portion, and the second shaft first end includes a second axially extending portion and a second finger portion, which is configured to selectively engage the first finger portion to establish the coupling therebetween.

In addition to the foregoing, the described assembly may include one or more of the following features: wherein when the first and second camshaft cartridges are at a maximum axial distance apart from each other allowed by the coupling, a space is established between the first and second finger portions; wherein the space has a width substantially equal to both a width of the first finger portion and a width of the second finger portion; wherein the first camshaft cartridge is configured to selectively push or pull the second camshaft cartridge when imparting movement to the second camshaft cartridge; wherein the camshaft assembly only includes a single actuator; and wherein the first and second camshaft cartridges are rotationally fixed to the camshaft.

In addition to the foregoing, the described assembly may include one or more of the following features: wherein the plurality of first cam lobes includes four first cam lobes, and wherein the plurality of second cam lobes includes three second cam lobes; wherein the four first cam lobes include a single first cam lobe configured to provide a low lift to the first engine valve, and three first cam lobes configured to provide a high lift to the first engine valve; wherein the three second cam lobes include a single second cam lobe configured to provide a high lift to the second engine valve, and two second cam lobes configured to provide a low lift to the second engine valve; and wherein in a first position, the first camshaft cartridge is positioned such that the single first cam lobe provides the low lift to the first engine valve, and the second camshaft cartridge is positioned such that a first of the two second cam lobes provides the low lift to the second engine valve.

In addition to the foregoing, the described assembly may include one or more of the following features: wherein when the first camshaft cartridge is axially shifted to a second position, a first of the three high lift first cam lobes is positioned to provide high lift to the first engine valve, and the first camshaft cartridge does not impart axial movement to the second camshaft cartridge; wherein when the first camshaft cartridge is axially shifted to a third position, a second of the three high lift cam lobes is positioned to provide high lift to the first engine valve, and the first camshaft cartridge axially pulls the second camshaft cartridge such that a second of the two second cam lobes provides low lift to the second engine valve; and wherein when the first camshaft cartridge is axially shifted to a fourth position, a third of the three high lift cam lobes is positioned to provide high lift to the first engine valve, and the first camshaft further axially pulls the second camshaft cartridge such that the high lift second cam lobe is positioned to provide high lift to the second engine valve.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

BRIEF DESCRIPTION OF THE DRAWINGS

FIG. 1 is a schematic illustration of an example camshaft assembly, in accordance with the principles of the present application.

DESCRIPTION

According to the principles of the present application, systems and methods are described for a camshaft assembly with two shifting camshaft cartridges controlled by a single actuator. The single actuator controls axial shifting of a master camshaft cartridge, which is operably coupled to a follower camshaft cartridge for selective movement thereof. This advantageously allows the actuator to be located anywhere along the master camshaft cartridge.

With initial reference to FIG. 1, a camshaft assembly 10 is illustrated in accordance with the principles of the present disclosure. In the example embodiment, the camshaft assembly 10 generally includes a camshaft 11, a first or controlling camshaft cartridge 12, a second or controlled camshaft cartridge 14, and an actuator assembly 16. As described herein in more detail, the controlling cartridge 12 is operably coupled to the controlled cartridge 14 by a coupling 18. The actuator assembly 16 is configured to control axial movement of the controlling cartridge 12, which due to the coupling 18, is configured to selectively push or pull the controlled cartridge 14 to provide axial movement thereto.

In the example embodiment, the controlling cartridge 12 and the controlled cartridge 14 are axially displaceable along a longitudinal axis CA' of the camshaft 11, but non-rotatably coupled thereto. In the illustrated example, each of the first and second cam cartridges 12, 14 have an internally splined aperture (not shown) with teeth configured to meshingly engage with corresponding external teeth (not shown) formed on and extending radially outward from an outer diameter of the camshaft 11. In the example embodiment, the controlling cartridge 12 is configured to be axially displaceable between four positions along the longitudinal axis 'A while the controlled cartridge 14 is configured to be axially displaceable between three positions along the longitudinal axis CA'. It will be appreciated, however, each cartridge 12, 14 may have a greater or lesser number of positions depending on the type of and desired operation of the valvetrain the camshaft assembly 10 will be utilized with, as described herein in more detail.

In the illustrated example, the controlling cartridge 12 is operably associated with a first valve mechanism 20 for actuating a first engine valve (not shown), and the controlled cartridge 14 is operably associated with a second valve mechanism 22 for selectively actuating a second engine valve (not shown). In one example, the first and second valve mechanisms 20, 22 are roller finger followers (RFF) configured to provide lift to the associated engine valves. Each of the first and second engine valves may be associated with the same or different cylinders of an internal combustion engine (not shown).

In the example embodiment, the controlling cartridge 12 includes a first shaft 24 with a plurality of cam lobes 26*a-d*. The first shaft 24 is a tubular member configured to receive the camshaft 11 therethrough and includes a first end 28 and an opposite second end 30. In the example embodiment, the shaft first end 28 is operably associated with the actuator assembly 16, and the shaft second end 30 forms part of the coupling 18, as described herein in more detail. The cam lobes 26*a-d* are sized and shaped to selectively actuate the valve mechanism 20 with a particular valve lift and duration to thereby provide a desired valve lift profile of the first engine valve. In the illustrated example, cam lobe 26*a* is configured to provide a low lift profile, while cam lobes 26*b-d* are configured to provide a high lift profile. As shown, each cam lobe 26*a-d* has an equal or substantially equal spacing or width 'w'. Moreover, it will be appreciated that controlling cartridge 12 may have any number of cam lobes 26 to be adapted to various different systems.

As noted above, the controlling cartridge 12 is axially displaceable along the camshaft 11, but rotatably fixed thereto. In the example embodiment, the controlling cartridge 12 is axially displaceable between four different positions. In the first position (FIG. 1), cam lobe 26*a* is positioned to engage the valve mechanism 20 and provide a low lift to the first engine valve. In the second position, controlling cartridge 12 is shifted one width 'w' such that cam lobe 26*b* is positioned to engage the valve mechanism 20 and provide a high lift to the first engine valve. In the third position, controlling cartridge is further shifted one width 'w' such that cam lobe 26*c* is positioned to engage the valve mechanism 20 and continues to provide the high lift to the first engine valve. In the fourth position, controlling cartridge 12 is again shifted one width 'w' such that cam lobe 26*d* is positioned to engage the valve mechanism 20 and continues to provide the high lift to engine valve.

In the example embodiment, the controlled cartridge 14 includes a second shaft 32 with a plurality of cam lobes 34*a-c*. The second shaft 32 is a tubular member configured to receive the camshaft 11 therethrough and includes a first end 36 and an opposite second end 38. In the example embodiment, the shaft first end 36 forms part of the coupling 18, as described herein in more detail. The cam lobes 34*a-c* are sized and shaped to selectively actuate the valve mechanism 22 with a particular valve lift and duration to thereby provide a desired valve lift profile of the second engine valve. In the illustrated example, cam lobes 34*a-b* are configured to provide a low lift profile, while cam lobes 34*c* is configured to provide a high lift profile. As shown, each cam lobe 34*a-c* also has an equal or substantially equal spacing or width 'w'. Moreover, it will be appreciated that controlled cartridge 14 may have any number of cam lobes 34 to be adapted to various different systems.

As noted above, the controlled cartridge 14 is axially displaceable along the camshaft 11, but rotatably fixed thereto. In the example embodiment, the controlled cartridge 14 is axially displaceable between three different positions. In the first position (FIG. 1), the controlled cartridge 14 is positioned such that cam lobe 34*a* is positioned to engage the valve mechanism 22 and provide a low lift to the second engine valve. In the second position, controlled cartridge 14 is shifted one width 'w' such that cam lobe 34*b* is positioned to engage the valve mechanism 22 and continues to provide the low lift to the second engine valve. This second position of the controlled cartridge 14 corresponds to the third position of the controlling cartridge 12. In the third position, controlled cartridge 14 is shifted one width 'w' such that the cam lobe 34*c* is positioned to engage the valve mechanism 22 and provide a high lift to the second engine valve. This third position of the controlled cartridge 14 corresponds to the fourth position of the controlling cartridge 12.

With continued reference to FIG. 1, the actuator assembly 16 and coupling 18 will be described in more detail. As noted, the actuator assembly 16 is configured to control axial movement of the controlling cartridge 12, which is thereby configured to control axial movement of the controlled cartridge 14 via the coupling 18. This advantageously allows dual camshaft cartridges to be controlled by a single actuator assembly 16. This also allows the actuator assembly 16 to be positioned anywhere along the controlling cartridge 12 (rather than in between two camshaft cartridges), which provides increased flexibility with packaging and design.

In the example embodiment, the actuator assembly 16 includes an actuator 39 with one or more actuator pins 40 (only one shown) configured to selectively engage a first ramp profile 42, a second ramp profile 44, and a third ramp profile 46. It will be appreciated, however, that the described configuration of actuator assembly 16 and operational integration is only one example configuration and that actuator assembly 16 and cartridge 12 may have any suitable components/configuration that enables controlling cartridge 12 to be axially shifted as described herein. In the example embodiment, the actuator pin 40 is disposed perpendicular to or substantially perpendicular to the longitudinal axis 'A and is selectively translated toward the axis CA' into engagement with the first ramp profile 42 to move the controlling cartridge 12 from the first position to the second position. If only the second position is desired, the actuator pin 40 is withdrawn away from the first ramp profile 42 such that controlling cartridge 12 remains in the second position.

If the third position is desired, the actuator pin 40 engages the second ramp profile 44 to move the controlling cartridge 12 from the second position to the third position. If only the third position is desired, the actuator pin 40 is withdrawn away from the second ramp profile 44 such that controlling cartridge 12 remains in the third position. If the fourth position is desired, the actuator pin 40 engages the third ramp profile 46 to move the controlling cartridge 12 from the third position to the fourth position. The actuator pin 40 may then be withdrawn toward the actuator 39 so the controlling cartridge 12 remains in the fourth position. The process may be reversed to move the controlling cartridge 12 back to any of the third, second, or first positions.

In the example embodiment, the coupling 18 is established by engaging cooperation between the first shaft second end 30 and the second shaft first end 36. As shown, the first shaft second end 30 includes a first axially extending portion 50 and a first inwardly extending hook or finger portion 52. Similarly, the second shaft first end 36 includes a second axially extending portion 54 and a second inwardly extending hook or finger portion 56. As illustrated in FIG. 1, the controlling cartridge 12 and the controlled cartridge 14 are shown at a maximum axial distance apart from each other allowed by the coupling 18 (i.e., the first and second finger portions 52, 56 engage each other and prevent further axial movement apart). It will be appreciated, however, that coupling 18 may have any suitable number of finger portions 52, 56.

In this max distance position, a space 58 is established between the first and second finger portions 52, 56. Notably, at least one of the finger portions 52, 56 and the space 58 each have a width 'w' equal or substantially equal to the width 'w' of each cam lobe 26 and 34. Moreover, in some embodiments, each of the first and second axially extending portions 50, 54 have a width 2*w* such that, as shown in FIG. 1, the first axially extending portion 50 has a width equal to or substantially equal to the width of the second finger portion 56 and the space 58. Similarly, the second axially extending portion 54 has a width equal to or substantially equal to the width of the first finger portion 52 and the space 58.

In one example method of operation of the camshaft assembly 10, the controlling cartridge 12 and the controlled cartridge 14 begin at their maximum axial distance relative to each other, as shown in FIG. 1. In this position, the controlling cartridge 12 is positioned with cam lobe 26*a* selectively engaging the valve mechanism 20 to provide a low lift to the associated engine valve of a first cylinder (not shown). Similarly, the controlled cartridge 14 is positioned with cam lobe 34*a* selectively engaging the valve mechanism 22 to provide a low lift to the associated engine valve of a second cylinder (not shown). Thus, in this position, both valve mechanisms 20, 22 are operated in the low lift mode. The operation of the camshaft assembly 10 can then be switched such that valve mechanism 20 operates in a high lift mode while the valve mechanism 22 operates the low lift mode, or both valve mechanisms 20, 22 operate in the high lift mode, as described in more detail.

In a first switching operation, actuator assembly 16 axially shifts the controlling cartridge 12 to the second position where cam lobe 26*b* provides high lift to the valve mechanism 20. During this shift movement, the first finger portion 52 is moved axially leftward one width 'w' (as shown in FIG. 1) such that first finger portion 52 now occupies the space 58, but does not impart axial movement to the controlled cartridge 14. As such, the controlled cartridge 14 remains in the first position and operates the valve mechanism 22 in the low lift mode while the valve mechanism 20 operates in the high lift mode.

In a subsequent second switching operation, actuator assembly 16 further axially shifts the controlling cartridge 12 to the third position where cam lobe 26*c* engages and provides high lift to the valve mechanism 20. During this shift movement, the first finger portion 52 engages the second finger portion 54 and pulls the controlled cartridge 14 axially leftward one width 'w' such that cam lobe 34*b* engages and provides low lift to the valve mechanism 22. As such, the controlling cartridge 12 imparts axial movement to the controlled cartridge 14 through the coupling 18 such that controlling cartridge 12 is in the third position and the controlled cartridge 14 is in the second position. In this way, the valve mechanism 20 is operated in the high lift mode and the valve mechanism 22 is operated in the low lift mode.

In a subsequent third switching operation, actuator assembly 16 next axially shifts the controlling cartridge 12 to the fourth position where cam lobe 26*d* engages and provides high lift to the valve mechanism 20. During this shift movement, the first finger portion 52 engages the second finger portion 54 and further pulls the controlled cartridge 14 axially leftward one width 'w' such that cam lobe 34*c* engages and provides high lift to the valve mechanism. As such, the controlling cartridge 12 imparts axial movement to the controlled cartridge 14 through the coupling 18 such that controlling cartridge 12 is in the fourth position and the controlled cartridge 14 is in the third position. In this way, camshaft assembly 10 now operates both valve mechanisms 20, 22 in the high lift mode. The shifting operations may then be reversed such that the first finger portion 52 engages an end surface 60 of the controlled cartridge 14 to impart rightward axial movement (as shown in FIG. 1) thereto to subsequently return to the axially distanced position shown in FIG. 1. Optionally, end surface 61 of controlling cartridge 12 can provide the engagement and rightward axial movement.

Described herein are systems and methods for shifting dual camshaft cartridges with a single actuator, which does not need to be disposed between the camshaft cartridges. Rather, the single actuator can be positioned anywhere along one of the camshaft cartridges, which can be translated axially to push or pull on the other camshaft cartridge to thereby impart axial movement thereto. In this way, the system can switch between two or more axial positions to provide variable valve lift or other variable engine operation.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A camshaft assembly for a vehicle valvetrain having first and second engine valves, the camshaft assembly comprising:

a camshaft;

a first camshaft cartridge axially displaceable along the camshaft and including a plurality of first cam lobes configured to selectively impart movement to the first engine valve;

a second camshaft cartridge axially displaceable along the camshaft and including a plurality of second cam lobes configured to selectively impart movement to the second engine valve;

a single actuator configured to axially displace the first camshaft cartridge along the camshaft; and a coupling between the first camshaft cartridge and the second camshaft cartridge, wherein axial displacement of the first camshaft cartridge selectively imparts movement to the second camshaft cartridge via the coupling for axial displacement of the second camshaft cartridge such that only the single actuator is needed to axially shift the first and second camshaft cartridges without having to directly engage the second camshaft cartridge, wherein the first camshaft cartridge is axially displaceable relative to the second camshaft cartridge.

2. The camshaft assembly of claim 1, wherein the first camshaft cartridge includes a first shaft having the plurality of first cam lobes, and wherein the second camshaft cartridge includes a second shaft having the plurality of second cam lobes.

3. The camshaft assembly of claim 2, wherein a first end of the first shaft is configured to engage a first end of the second shaft to form the coupling.

4. The camshaft assembly of claim 3, wherein the first shaft first end includes a first axially extending portion and a first finger portion, and the second shaft first end includes a second axially extending portion and a second finger portion, which is configured to selectively engage the first finger portion to establish the coupling therebetween.

5. The camshaft assembly of claim 4, wherein when the first and second camshaft cartridges are at a maximum axial distance apart from each other allowed by the coupling, a space is established between the first and second finger portions.

6. The camshaft assembly of claim 5, wherein the space has a width equal to both a width of the first finger portion and a width of the second finger portion.

7. The camshaft assembly of claim 1, wherein the first camshaft cartridge is configured to selectively push and selectively pull the second camshaft cartridge when imparting movement to the second camshaft cartridge.

8. The camshaft assembly of claim 7, wherein the camshaft assembly only includes the single actuator.

9. The camshaft assembly of claim 1, wherein the plurality of first cam lobes includes four first cam lobes, and wherein the plurality of second cam lobes includes three second cam lobes.

10. The camshaft assembly of claim 9, wherein the four first cam lobes include a single first cam lobe configured to provide a low lift to the first engine valve, and three first cam lobes configured to provide a high lift to the first engine valve.

11. The camshaft assembly of claim 10, wherein the three second cam lobes include a single second cam lobe configured to provide a high lift to the second engine valve, and two second cam lobes configured to provide a low lift to the second engine valve.

12. The camshaft assembly of claim 11, wherein in a first position, the first camshaft cartridge is positioned such that the single first cam lobe provides the low lift to the first engine valve, and the second camshaft cartridge is positioned such that a first of the two second cam lobes provides the low lift to the second engine valve.

13. The camshaft assembly of claim 12, wherein when the first camshaft cartridge is axially shifted to a second position, a second of the four first cam lobes is positioned to provide high lift to the first engine valve, and the first camshaft cartridge does not impart axial movement to the second camshaft cartridge.

14. The camshaft assembly of claim 13, wherein when the first camshaft cartridge is axially shifted to a third position, a third of the four first cam lobes is positioned to provide high lift to the first engine valve, and the first camshaft cartridge axially pulls the second camshaft cartridge such that a second of the two second cam lobes provides low lift to the second engine valve.

15. The camshaft assembly of claim 14, wherein when the first camshaft cartridge is axially shifted to a fourth position, a fourth of the four first cam lobes is positioned to provide high lift to the first engine valve, and the first camshaft cartridge further axially pulls the second camshaft cartridge such that the single second cam lobe is positioned to provide high lift to the second engine valve.

16. A camshaft assembly for a vehicle valvetrain having first and second engine valves, the camshaft assembly comprising:

a camshaft;

a first camshaft cartridge axially displaceable along the camshaft and including a plurality of first cam lobes configured to selectively impart movement to the first engine valve, a second camshaft cartridge axially displaceable along the camshaft and including a plurality of second cam lobes configured to selectively impart movement to the second engine valve;

a single actuator configured to axially displace the first camshaft cartridge along the camshaft; and a coupling between the first camshaft cartridge and the second camshaft cartridge, wherein axial displacement of the first camshaft cartridge selectively imparts movement to the second camshaft cartridge via the coupling for axial displacement of the second camshaft cartridge such that only the single actuator is needed to axially shift the first and second camshaft cartridges without having to directly engage the second camshaft cartridge, wherein the first and second camshaft cartridges are rotationally fixed to the camshaft, wherein the first camshaft cartridge includes a first hook portion, and the second camshaft cartridge includes a second hook portion, wherein the first hook portion and second hook portion form the coupling, and wherein axial displacement of the first camshaft cartridge causes the first hook portion to selectively push and selectively pull the second camshaft cartridge to impart movement to the second camshaft cartridge.

17. A vehicle valvetrain comprising:

a first engine valve;

a second engine valve;

a rotatable camshaft extending along a longitudinal axis;

a first camshaft cartridge axially displaceable along the camshaft and including a plurality of first cam lobes configured to selectively impart movement to the first engine valve;

a second camshaft cartridge separate and distinct from the first camshaft cartridge and axially displaceable along the camshaft and including a plurality of second cam lobes configured to selectively impart movement to the second engine valve;

a single actuator configured to axially displace the first camshaft cartridge along the camshaft; and a coupling between the first camshaft cartridge and the second camshaft cartridge, wherein axial displacement of the first camshaft cartridge by the single actuator selectively imparts movement to the second camshaft cartridge via the coupling for axial displacement of the second camshaft cartridge such that only the single actuator is needed to axially shift the first and second camshaft cartridges without having to directly engage the second camshaft cartridge with the single actuator, wherein a first end of the first camshaft cartridge is configured to engage a first end of the second camshaft cartridge to form the coupling, and wherein the first camshaft cartridge first end includes a first axially extending portion and an inwardly extending first finger portion, and the second camshaft cartridge first end includes a second axially extending portion and an inwardly extending second finger portion, which is configured to selectively engage the first finger portion to establish the coupling therebetween.

18. The vehicle valvetrain of claim 17, wherein the plurality of first cam lobes includes a low lift first cam lobe, a high lift second cam lobe, a high lift third cam lobe, and a high lift fourth cam lobe, and wherein the plurality of second cam lobes includes a low lift fifth cam lobe, a low lift sixth cam lobe, and a high lift seventh cam lobe.

* * * * *